US009765971B2

(12) United States Patent
Matsubara et al.

(10) Patent No.: US 9,765,971 B2
(45) Date of Patent: Sep. 19, 2017

(54) GAS TURBINE COMBUSTOR

(71) Applicant: MITSUBISHI HITACHI POWER SYSTEMS, LTD., Kanagawa (JP)

(72) Inventors: Yoshinori Matsubara, Yokohama (JP); Keisuke Miura, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 198 days.

(21) Appl. No.: 14/539,157

(22) Filed: Nov. 12, 2014

(65) Prior Publication Data

US 2015/0128601 A1 May 14, 2015

(30) Foreign Application Priority Data

Nov. 13, 2013 (JP) ..... 2013-234675

(51) Int. Cl.

| | |
|---|---|
| ***F23R 3/00*** | (2006.01) |
| ***F23R 3/28*** | (2006.01) |
| ***F23R 3/10*** | (2006.01) |
| *F23D 11/10* | (2006.01) |
| *F23R 3/12* | (2006.01) |
| *F23C 7/00* | (2006.01) |

(52) U.S. Cl.

CPC ..... *F23R 3/28* (2013.01); *F23R 3/10* (2013.01); *F23R 3/286* (2013.01); *F23C 7/002* (2013.01); *F23D 11/107* (2013.01); *F23R 3/12* (2013.01)

(58) Field of Classification Search

CPC .... F23R 3/28; F23R 3/10; F23R 3/286; F23R 3/12; F23C 7/002; F23D 11/107

See application file for complete search history.

(56) References Cited

U.S. PATENT DOCUMENTS 4,455,840 A * 6/1984 Matt ..... F23R 3/10 60/737

2004/0000146 A1 1/2004 Inoue et al.

(Continued)

FOREIGN PATENT DOCUMENTS

EP 2161501 A2 3/2010
EP 2481986 A2 8/2012

(Continued)

OTHER PUBLICATIONS

Extended European Search Report received in corresponding European Application No. 14192874.7 dated Mar. 23, 2015.

*Primary Examiner* — Gerald L Sung
*Assistant Examiner* — Katheryn Malatek
(74) *Attorney, Agent, or Firm* — Mattingly & Malur, PC

(57) ABSTRACT

A gas turbine combustor having a burner including a plurality of fuel nozzles for injecting fuel, air hole plates positioned on a downstream side of the fuel nozzles and a plurality of air holes arranged in pairs with each of the fuel nozzles, and a combustion chamber for mixing fuel injected from the fuel nozzles and air injected from the air holes and injecting and burning the mixed fuel. Each of the fuel nozzles configuring the burners is provided with a projection in which a part of an outer edge of a section of the fuel nozzle is protruded outward; and the projection is arranged so as to be directed toward a center of the gas turbine combustor. The projection of the fuel nozzle is positioned on a downstream side of a flow of combustion air flowing around each of the fuel nozzles.

8 Claims, 12 Drawing Sheets

(56) References Cited

U.S. PATENT DOCUMENTS

| | | | | |
|---|---|---|---|---|
| 2004/0011054 | A1 | 1/2004 | Inoue et al. | |
| 2004/0045297 | A1 | 3/2004 | Inoue et al. | |
| 2004/0163393 | A1 | 8/2004 | Inoue et al. | |
| 2004/0255589 | A1* | 12/2004 | Yoshida | F23R 3/343 60/746 |
| 2005/0000222 | A1 | 1/2005 | Inoue et al. | |
| 2005/0210880 | A1 | 9/2005 | Inoue et al. | |
| 2006/0016199 | A1 | 1/2006 | Inoue et al. | |
| 2006/0042264 | A1 | 3/2006 | Inoue et al. | |
| 2009/0111063 | A1 | 4/2009 | Boardman et al. | |
| 2011/0072824 | A1* | 3/2011 | Zuo | F23D 14/62 60/746 |
| 2012/0023952 | A1* | 2/2012 | Vandervort | F23C 6/045 60/748 |
| 2012/0192568 | A1* | 8/2012 | Miura | F23R 3/286 60/776 |
| 2012/0297786 | A1* | 11/2012 | Crawley | F23R 3/02 60/772 |

FOREIGN PATENT DOCUMENTS

| | | | |
|---|---|---|---|
| EP | 2527741 | A2 | 11/2012 |
| JP | 2003-148734 | A | 5/2003 |
| JP | 2009-192175 | A | 8/2009 |
| JP | 2011-058775 | A | 3/2011 |

* cited by examiner

GAS TURBINE COMBUSTOR

CLAIM OF PRIORITY

The present application claims priority from Japanese patent application JP 2013-234675 filed on Nov. 13, 2013, the content of which is hereby incorporated by reference into this application.

TECHNICAL FIELD

The present invention relates to a gas turbine combustor.

BACKGROUND ART

From a viewpoint of environment protection, the gas turbine combustor is required for a further reduction of the NOx emission. As a measure for reduction of the NOx emission of the gas turbine combustor, a premixing combustor may be cited, though in this case, a flashback is worried that is a phenomenon in which a flame may enter the premixing combustor and damages the combustor.

Japanese Patent Laid-open No. 2003-148734 (Patent Literature 1) discloses a gas turbine combustor which is configured with plural fuel nozzles for feeding fuel to a combustion chamber and many air holes for feeding air that are positioned on the downstream side of the fuel nozzles and the injection holes of the fuel nozzles and the air holes are arranged coaxially.

CITATION LIST

Patent Literature

Patent Literature 1

Japanese Patent Laid-open No. 2003-148734

SUMMARY OF INVENTION

Technical Problem

The gas turbine combustor is required to be operated stably under wide operation conditions from ignition to full load and reduce the NOx emission.

In the gas turbine combustor disclosed in Patent Literature 1, the multi-burner structure with a plurality of burners arranged and the mixing enhancement structure by fuel nozzles are disclosed, though a problem arises that when combustion air flows in the space wherein a plurality of fuel nozzles are lined on the upstream side of the air hole plates of the burners, a pressure loss due to separating of the flow generated behind the fuel nozzles is caused.

The pressure loss in the gas turbine combustor is related to an efficiency reduction of the entire gas turbine, so that to increase the efficiency of the gas turbine, it is necessary to reduce the pressure loss in the gas turbine combustor.

An object of the present invention is to provide a gas turbine combustor capable of reducing the pressure loss of the gas turbine combustor without increasing the NOx emission.

Solution to Problem

A gas turbine combustor of the present invention comprising a burner including a plurality of fuel nozzles for injecting fuel, an air hole plates positioned on a downstream side of the fuel nozzles and configured by each of the fuel nozzles and a plurality of air holes arranged in pairs with each of the fuel nozzles, and a combustion chamber for mixing fuel injected from the fuel nozzles configuring the burners and air injected from the air holes and injecting and burning the mixed fuel, characterized in that, each of the fuel nozzles configuring the burners is provided with a projection in which a part of an outer edge of a section of the fuel nozzle is protruded outward; the projection is arranged so as to be directed toward a center of the gas turbine combustor; and the projection of the fuel nozzle is positioned on a downstream side of a flow of combustion air flowing around each of the fuel nozzles.

Advantageous Effects of Invention

According to the present invention, a gas turbine combustor capable of reducing the pressure loss of the gas turbine combustor without increasing the NOx emission can be realized.

DESCRIPTION OF EMBODIMENTS

Figure 1:
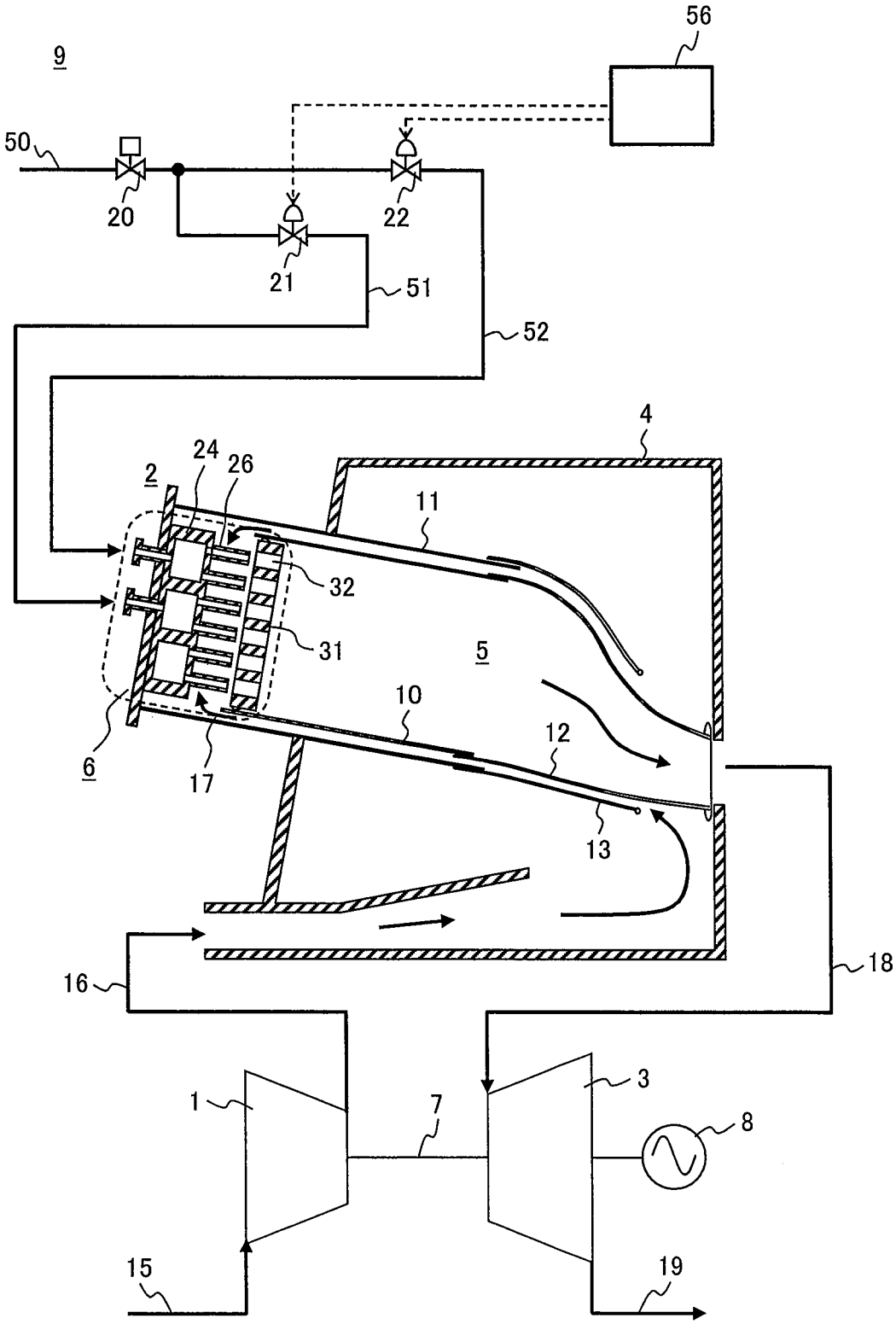
FIG. 1 is a plant system diagram showing the rough structure of the gas turbine plant to which the gas turbine combustor in the first embodiment of the present invention is applied.

The gas turbine combustor which is an embodiment of the present invention will be explained below by referring to the drawings.

Embodiment 1

The gas turbine combustor which is the first embodiment of the present invention will be explained by referring to FIGS. 1, 2A, 2B, 3C, 3D, 4, and 5.

FIG. 1 is the plant system diagram showing the rough structure of the gas turbine plant to which the gas turbine combustor in the first embodiment of the present invention is applied.

In the gas turbine plant shown in FIG. 1, the power generation gas turbine includes a compressor 1 for pressuring suction air 15 to generate high-pressure air 16, a combustor 2 for burning the high-pressure air 16 generated by the compressor 1 and gas fuel 50 to generate high-temperature combustion gas 18, a turbine 3 driven by the high-temperature combustion gas 18 generated by the gas turbine combustor 2, a generator 8 driven by the turbine 3 and generating electric power, and a shaft 7 for integrally connecting the compressor 1, the turbine 3, and the generator 8.

And, the gas turbine combustor 2 is stored inside a casing 4. Further, the gas turbine combustor 2 includes a burner 6 on the top thereof and an almost cylindrical liner 10 for separating the high-pressure air and the combustion gas inside the combustor 2 on the downstream side of the burner 6.

On the outer periphery of the liner 10, a flow sleeve 11 as an outer peripheral wall forming an air flow path through which the high-pressure air flows down is arranged. The flow sleeve 11 is larger in diameter than the liner 10 and is arranged cylindrically in an almost concentric circle with the liner 10.

Further, on the downstream side of the liner 10, transition piece 12 for leading the high-temperature combustion gas 18 generated in a combustion chamber 5 of the gas turbine combustor 2 is arranged. Further, on the outer periphery side of the transition piece 12, a flow sleeve 13 is arranged.

The suction air 15, after compressed by the compressor 1, becomes the high-pressure air 16 and at the gas turbine rated load, becomes high temperature of 400° C. or higher depending on the pressure ratio.

The high-pressure air 16, after entering the casing 4, flows into the space between the transition piece 12 and the flow sleeve 13 and cools the transition piece 12 by convection cooling.

Furthermore, the high-pressure air 16, via the circular flow path formed between the flow sleeve 11 and the liner 10, flows toward the top of the gas turbine combustor 2. The high-pressure air 16, in the middle of the flow, is used for the convection cooling of the liner 10.

Further, a part of the high-pressure air 16 is injected from many cooling holes provided in the liner 10 into the liner 10 along the inner wall surface thereof to form a cooling air film and protects and cools the liner 10 from the high-temperature combustion gas 18.

Among the high-pressure air 16, residual combustion air 17 which is not used to cool the liner 10 flows into the combustion chamber 5 from many air holes 32 provided in air hole plates 31 positioned on the wall surface of the combustion chamber 5 on the upstream side.

The combustion air 17 flowing from the many air holes 32 into the liner 10 is burned together with the fuel injected from fuel nozzles 26 in the combustion chamber 5 and generates the high-temperature combustion gas 18.

The high-temperature combustion gas 18 is fed to the turbine 3 via the transition piece 12. The high-temperature combustion gas 18 is discharged after driving the turbine 3 and becomes exhaust gas 19.

The driving force obtained by the turbine 3 is transmitted to the compressor 1 and the generator 8 via the shaft 7. A part of the driving force obtained by the turbine 3 drives the compressor 1, pressurizes air, and generates high-pressure air. Further, another part of the driving force obtained by the turbine 3 rotates the generator 8 to generate electric power.

The burner 6 installed on the top of the gas turbine combustor 2 includes plural fuel systems 51 and 52. The fuel systems 51 and 52 include fuel flow control valves 21 and 22 respectively, and the flow rates of the fuel systems 51 and 52 are adjusted by the fuel flow control valves 21 and 22 respectively, and the power generation rate of a gas turbine plant 9 is controlled.

Further, on the upstream side branching to the plurality of fuel systems 51 and 52, a fuel cutoff valve 20 for cutting off the fuel is installed.

Figure 2A:
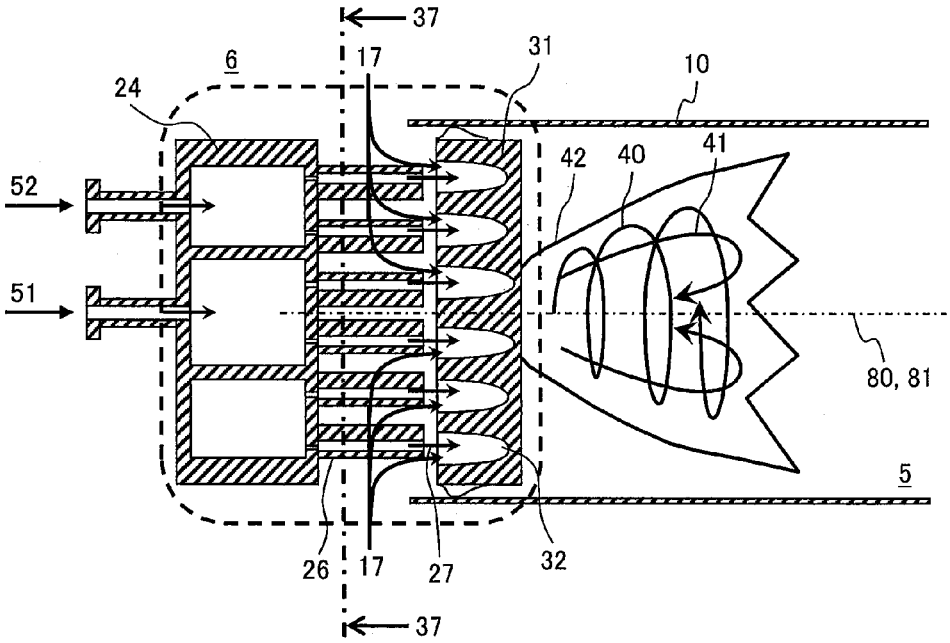
FIG. 2A is an axial cross sectional view of the gas turbine combustor in the first embodiment of the present invention.
Figure 2B:
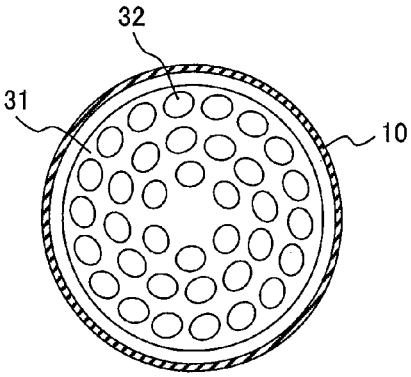
FIG. 2B is a front view of the gas turbine combustor in the first embodiment of the present invention shown in FIG. 2A viewed from the downstream side of the combustion chamber.

FIG. 2A shows the axial cross sectional view of the gas turbine combustor 2 in the first embodiment and FIG. 2B shows the front view of the gas turbine combustor 2 viewed from the downstream side of the combustion chamber 5.

The gas turbine combustor 2 in the present embodiment is configured by one burner 6 and the burner 6 is configured by many fuel nozzles 26, a fuel nozzle header 24 for distributing the fuel to the many fuel nozzles 26, and the air hole plates 31 where the many air holes 32 with air and fuel passing through are arranged in one-to-one correspondence with the fuel nozzles 26.

The fuel nozzles 26 and the air holes 32 formed in the air hole plates 31 are arranged circularly on three rows of concentric circles around a center axis 80 of the burner 6. The combustion air 17 flows in from the outer periphery of the burner 6, by slipping through the gaps of the plurality of fuel nozzles 26 and flowing toward the burner center 80, flows into the air holes 32 formed in the air hole plates 31.

In the air holes 32 of the air hole plates 31, the combustion air 17 and a fuel jet stream 27 are mixed and the mixed gas is fed to the combustion chamber 5. Further, the air holes 32 of the burner are formed so as to be inclined to the axial center of the combustion chamber 5, thus a swirl flow 40 is formed on the downstream side of the burner 6, and by a recirculation flow 41 generated by the swirl flow 40, a flame 42 is formed.

The gas turbine combustor 2 of this embodiment is configured by one burner 6, so that the center axis 80 of the burner 6 and a center axis 81 of the gas turbine combustor 2 coincide with each other.

Here, the shape of the fuel nozzles 26 configuring the burner 6 of the gas turbine combustor 2 in the present embodiment will be shown.

Figure 3A:
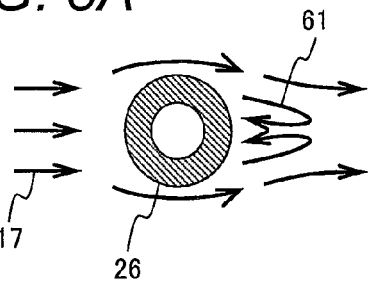
FIG. 3A (PRIOR ART)
FIG. 3A is a cross sectional view of a fuel nozzle showing the flow of the combustion air around the fuel nozzle of a conventional embodiment.
Figure 3B:
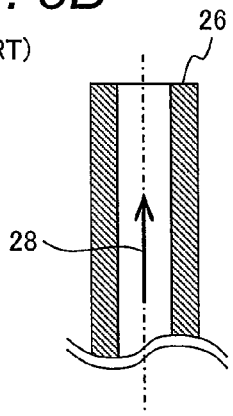
FIG. 3B (PRIOR ART)
FIG. 3B is an axial cross sectional view of the fuel nozzle showing the shape of the fuel nozzle in a conventional embodiment shown in FIG. 3A and the flow of the fuel flow flowing through the fuel nozzle.
Figure 3C:
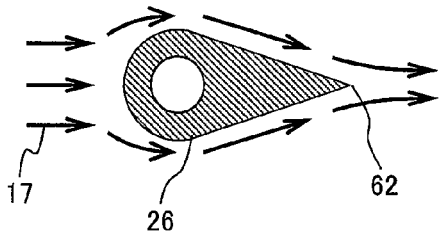
FIG. 3C is a cross sectional view of a fuel nozzle showing the shape of a fuel nozzle of one aspect of an embodiment of the gas turbine combustor in the first embodiment of the present invention and the flow of the combustion air around it.
Figure 3D:
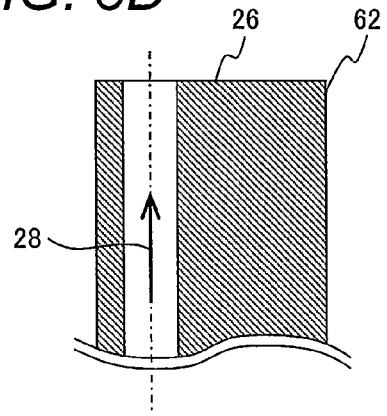
FIG. 3D is an axial cross sectional view of the fuel nozzle showing the shape of the fuel nozzle of the gas turbine combustor in the first embodiment of the present invention shown in FIG. 3C, and the flow of the fuel flow flowing through the fuel nozzle.

FIG. 3A and FIG. 3B are the drawings showing the flow of the combustion air 17 around the fuel nozzle 26 when the cross sectional shape of the fuel nozzle 26 configuring the burner 6 of the gas turbine combustor 2 is circular similarly to the fuel nozzle of the conventional embodiment and the flow of fuel 28 through the fuel nozzle, and FIG. 3C and FIG. 3D are the drawings showing the shape of the fuel nozzle 26 of one aspect of an embodiment configuring the burner 6 of the gas turbine combustor 2 in the first embodiment of the present invention and the flow of the combustion air around it.

As shown in FIG. 3A and FIG. 3B, in the case of the fuel nozzle 26 of the conventional embodiment having a circular cross sectional shape, the combustion air 17 flowing around the fuel nozzle 26, since the flow is separated behind it, a recirculation flow 61 is formed, and this occurs in a plurality of fuel nozzles, leading to a pressure loss of the gas turbine combustor.

Therefore, in the gas turbine combustor 2 of the present embodiment shown in FIG. 3C and FIG. 3D, the shape of the fuel nozzle 26 configuring the burner 6 is formed so that a part of the outer peripheral side of the section of the fuel nozzle 26 is protruded outward to form an edge 62 of a projection, and the edge 62 of the fuel nozzle 26 is arranged so as to be positioned on the downstream side of the combustion air 17 flowing around the fuel nozzle 26.

And, the edge 62 of the projection protruded outside the fuel nozzle 26 is arranged toward the downstream side of the flow of the combustion air 17, thus the flow of the combustion air 17 around the fuel nozzle 26 is adjusted, so that the formation of a recirculation flow due to separating is suppressed and a reduction of the pressure loss of the gas turbine combustor 2 can be realized.

Figure 4:
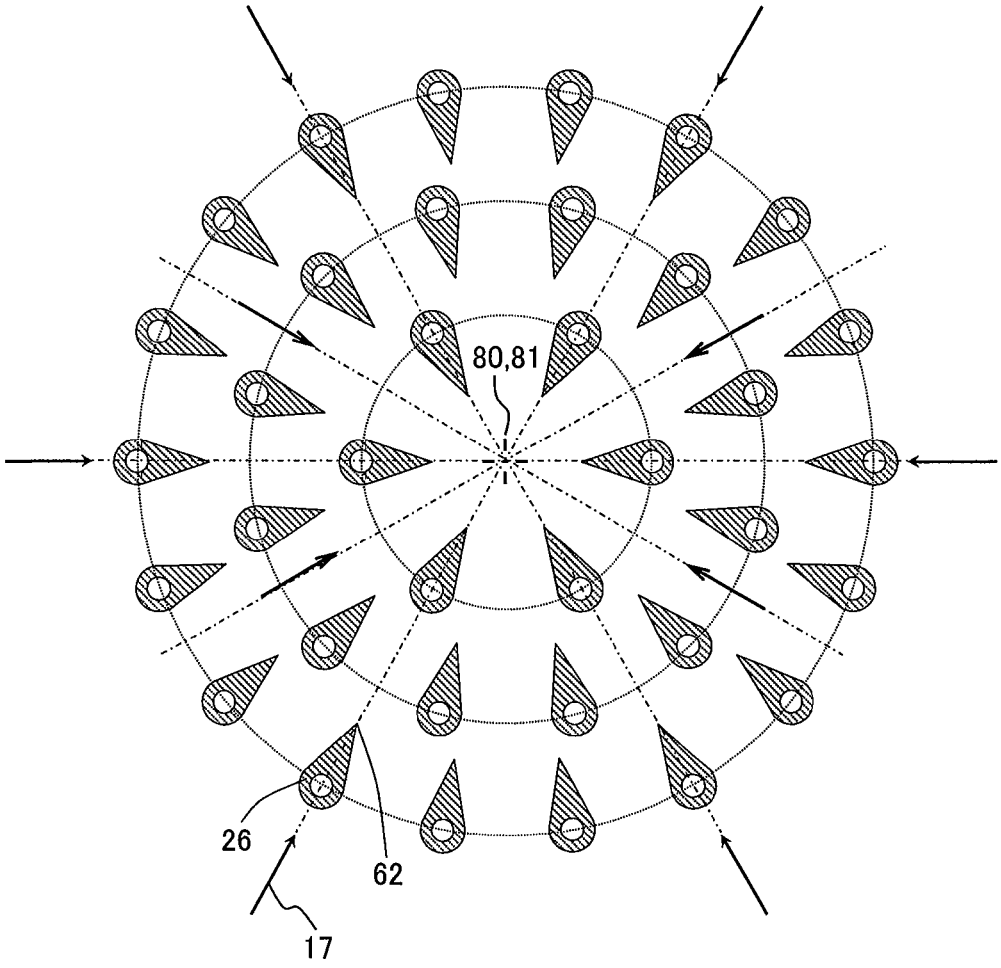
FIG. 4 is an arrangement diagram of the fuel nozzle showing the arrangement method of the fuel nozzle by the axial perpendicular section of the gas turbine combustor including the fuel nozzle in the first embodiment of the present invention.

In FIG. 4, by the axial perpendicular sectional drawing of the burner 6 of the gas turbine combustor 2 of a section 37 shown in FIG. 2A and FIG. 3D, the arrangement method of the fuel nozzle 26 configuring the burner 6 of the gas turbine combustor 2 of the present embodiment is shown.

As shown in FIG. 2A and FIG. 4, in the space between the air hole plates 32 and the fuel nozzle header 24, the combustion air 17 flows from the outer periphery of the burner 6 toward the center 80 thereof by slipping through the gaps of the plurality of fuel nozzles 26.

The edge 62 which is a projection formed at each rear edge of the fuel nozzles 26 configuring the burner 6 of the gas turbine combustor 2 of the present embodiment is arranged so as to be directed to the burner center in the downstream direction of the flow of the combustion air 17.

In FIGS. 2A, 2B, and 4, the many fuel nozzles 26 configuring the burner 6 of the gas turbine combustor 2 and the many air holes 32 formed in the air hole plates 31 in pairs with these many fuel nozzles 26 are arranged coaxially in a plurality of rows outward radially from the center of the gas turbine combustor 2, for example, in three rows in FIG. 4, though they are not restricted to three rows and may be arranged coaxially in four rows or more.

Further, the arrangement of the many air holes 32, if they are arranged circularly in the respective rows, is not restricted to arrangement on a concentric circle with the burner 6 and the center of each circle may be different from the burner center 80.

Figure 5A:
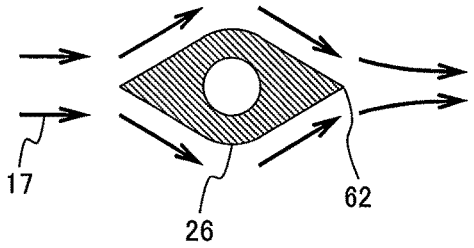
FIG. 5A is a cross sectional view of the fuel nozzle showing the sectional shape of one aspect of an embodiment in the axial perpendicular direction of the fuel nozzle in the first embodiment of the present invention.

Further, if the separating of the combustion air flow behind each fuel nozzle 26 can be suppressed, the shape of the section of the fuel nozzle 26 on the upstream side of the flow is not restricted to the round shape as shown in FIG. 3C and FIG. 3D but may be the shape in which an edge similar to the edge 62 of the rear edge as shown in FIG. 5A is formed.

Figure 5B:
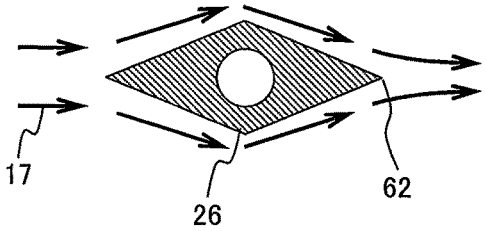
FIG. 5B is a cross sectional view of the fuel nozzle showing the sectional shape of another aspect of an embodiment in the axial perpendicular direction of the fuel nozzle in the first embodiment of the present invention.

Further, with respect to the flow in the section shape of the fuel nozzle 26, the shapes of the section of the fuel nozzle 26 on the upstream side and the downstream side, as shown in FIG. 5A, may be formed so as to become a shape smoothly connected or as shown in FIG. 5B, may be connected in a discontinuous shape in such a way that the inclined surfaces cross each other.

Figure 5C:
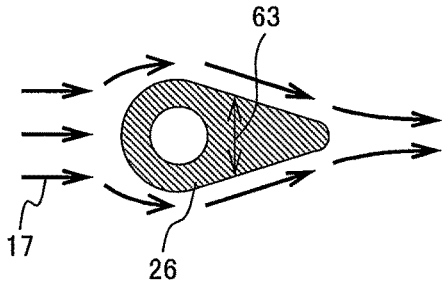
FIG. 5C is a cross sectional view of the fuel nozzle showing the sectional shape of still another aspect of an embodiment in the axial perpendicular direction of the fuel nozzle in the first embodiment of the present invention.

To suppress the separating of the flow of the combustion air behind the fuel nozzle 26 and reduce the pressure loss, the shape of the edge 62 in which the rear edge of the fuel nozzle 26 becomes a projection projected outward is optimum, though as shown in FIG. 5C, if the projection is shaped so that a width 63 of the projection of the fuel nozzle 26 for the flow on the axial perpendicular section is slowly reduced in the downstream direction, the separating of the flow is suppressed at its minimum, so that the shape of the projection at the rear edge of the fuel nozzle 26 is not restricted to an edge shape and may form a curvature.

Figure 5D:
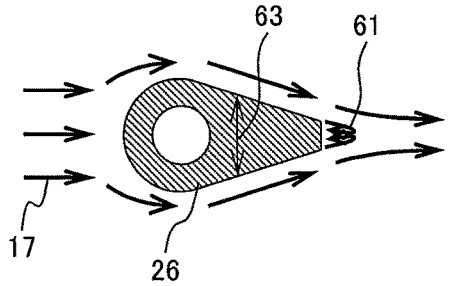
FIG. 5D is a cross sectional view of the fuel nozzle showing the sectional shape of a further aspect of an embodiment in the axial perpendicular direction of the fuel nozzle in the first embodiment of the present invention.

Further, as shown in FIG. 5D, for the shape of the projection of the fuel nozzle 26, even if the rear edge of the edge portion is plane, the recirculation region 61 becomes smaller than the recirculation region generated behind the circular section shown in FIG. 3A and FIG. 3B, so that the pressure loss can be reduced.

In FIGS. 3C, 3D, 5A, 5B, 5C, and 5D, the structure of the projection formed at the rear edge of the fuel nozzle 26 capable of reducing the pressure loss is shown, though as for the nozzle 26 of the gas turbine combustor 2, the projections formed at the rear edge of the fuel nozzle 26 may have all the same shape and the projections formed at the rear edge of the fuel nozzle 26 may be arranged in combination with a plurality of different shapes.

For the burner 6 of the gas turbine combustor 2 in the present embodiment, the fuel nozzle 26 in the aforementioned structure with the projection formed at the rear edge is used, thus the flow around the fuel nozzle 26 is adjusted and unsteady hydrodynamic force acting on the fuel nozzles 26 caused by the separating of the flow is suppressed and the reliability of the structure of the gas turbine combustor 2 is improved.

Further, on the downstream side of the pairs of the focused fuel nozzle 26 and the air hole 32 formed in the air hole plate 31 to be focused, that is, turbulence of the combustion air 17 flowing into the pairs of the fuel nozzle 26 closer to the center of the burner 6 and the air hole 32 is reduced, so that the flow-in rate of the combustion air into the air hole 32 is unified, and the local fuel air ratio in the combustion chamber 5 of the gas turbine combustor 2 becomes uniform, thus the NOx emission is reduced.

As explained above, according to the present embodiment, a gas turbine combustor capable of reducing the pressure loss without increasing the NOx emission can be realized.

Embodiment 2

Next, the gas turbine combustor 2 which is the second embodiment of the present invention will be explained by referring to FIGS. 6A, 6B, and 7.

In the gas turbine combustor 2 of the second embodiment, the explanation of the structure and operation effects common to the gas turbine combustor 2 of the first embodiment is omitted and only the different portions will be explained below.

Figure 6A:
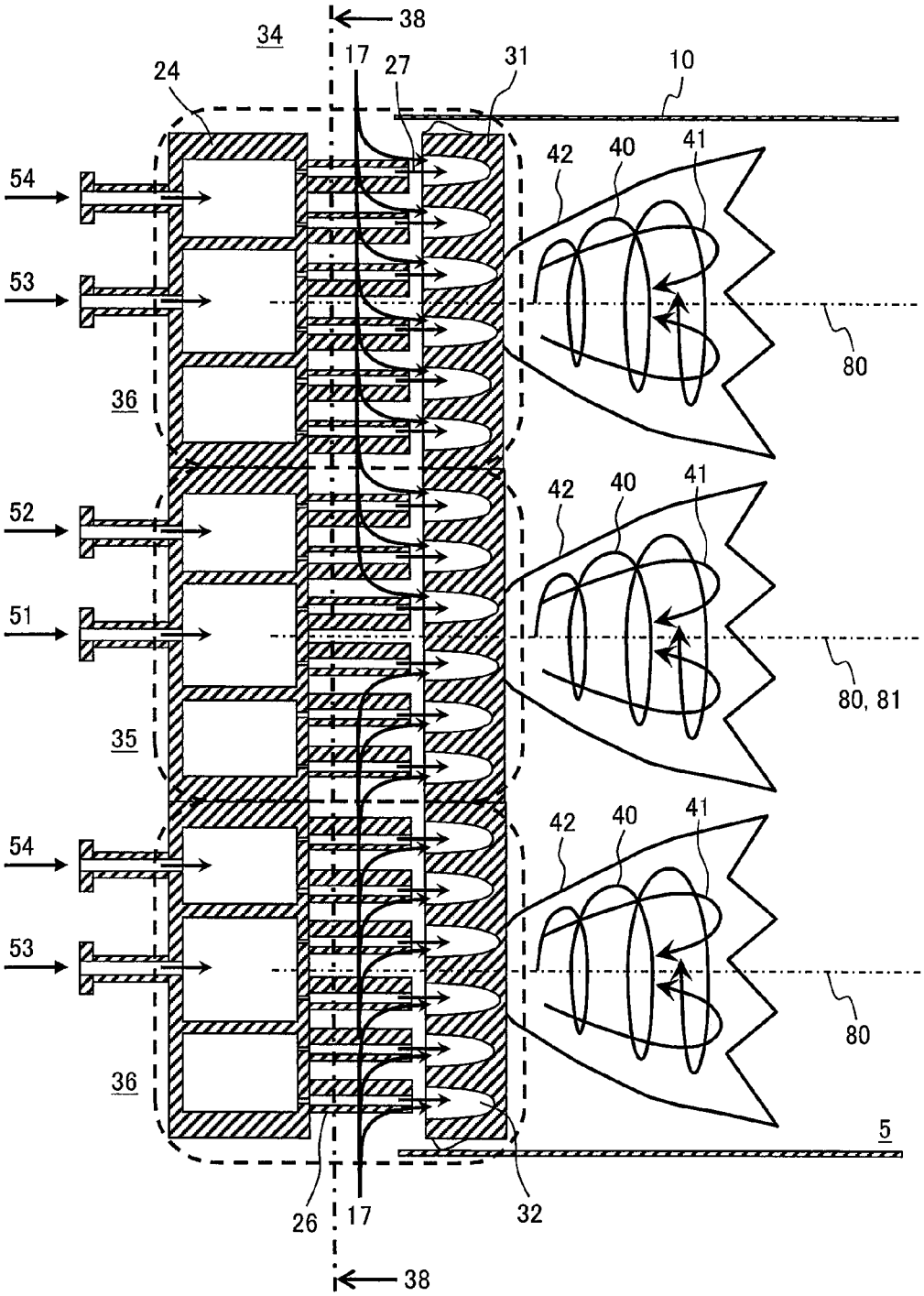
FIG. 6A is an axial cross sectional view of the gas turbine combustor in the second embodiment of the present invention.
Figure 6B:
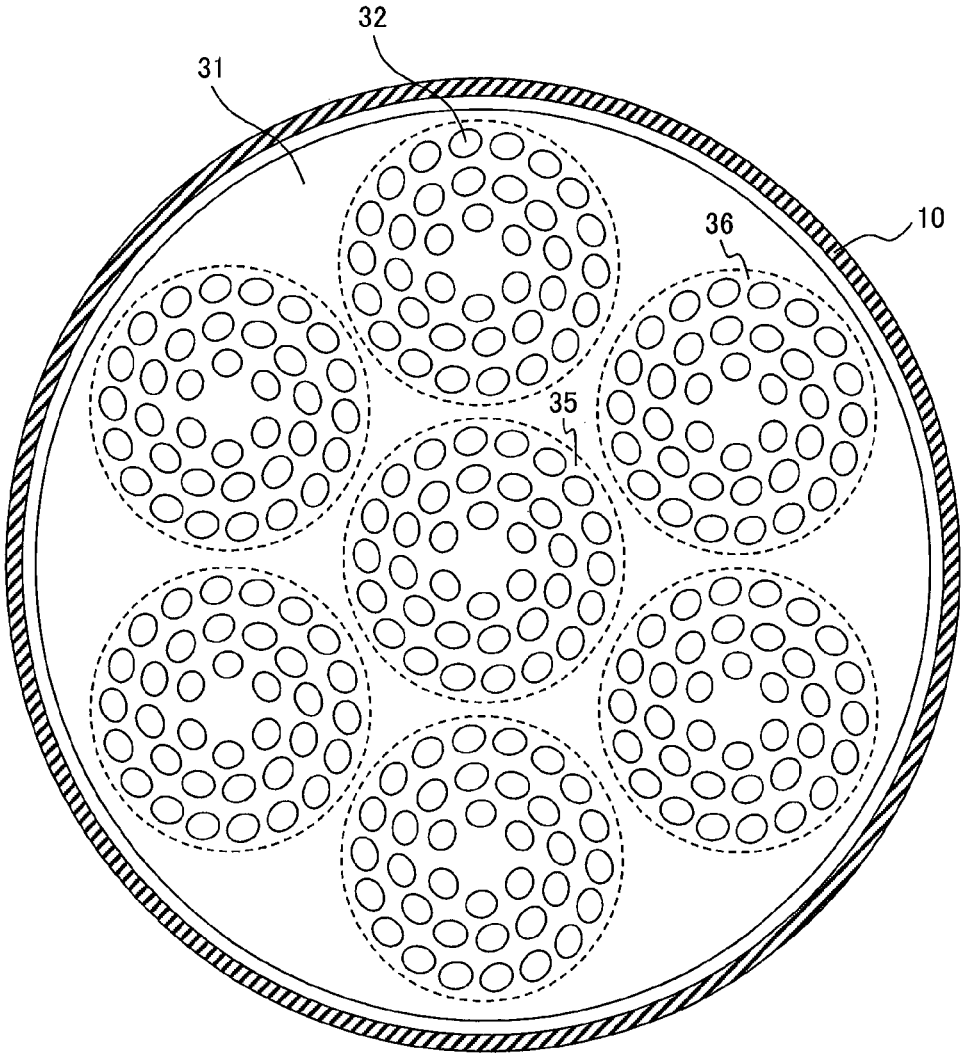
FIG. 6B is a front view of the gas turbine combustor in the second embodiment of the present invention shown in FIG. 6A viewed from the downstream side of the combustion chamber.

FIG. 6A shows the axial cross sectional view of the gas turbine combustor 2 of the second embodiment and FIG. 6B shows the front view of the gas turbine combustor 2 shown in FIG. 6A viewed from the downstream side of the combustion chamber 5.

In the gas turbine combustor 2 of the present embodiment shown in FIGS. 6A and 6B, as for the burner 6 of the gas turbine combustor 2 of the first embodiment shown in FIGS. 2A and 2B, one central burner 35 is arranged on the inner peripheral side which is the center of the gas turbine combustor 2, and on the outer periphery thereof, a plurality of outer peripheral burners 36 (for example, six burners) are arranged, and in combination with each other, one multi-burner 34 is structured.

In the gas turbine combustor 2 of the present embodiment, the structure of the multi-burner 34 as shown in FIGS. 6A and 6B is used, thus the fuel system is pluralized such as 51 to 54, and with the change of the gas turbine load, the gas turbine combustor 2 can cope flexibly, and depending on the number of combinations, a gas turbine combustor different in the capacity per each can be provided comparatively easily.

Even in the multi-burner 34 of the gas turbine combustor 2 shown in the present embodiment, the combustion air 17 flows in from the outer periphery of the multi-burner 34, slips through the gaps of the plurality of fuel nozzles 26 of the outer peripheral burners 36 and the gaps of the plurality of outer peripheral burners 36 and furthermore the gaps of the plurality of fuel nozzles 26 of the central burner 35, flows toward the combustor center 81, and flows into the air holes 32 of the plurality of outer peripheral burners 36 and the central burner 35.

As a fuel nozzle 26 in the gas turbine combustor 2 of the present embodiment, any of the shapes of the fuel nozzle 26 shown in the gas turbine combustor 2 of the first embodiment is acceptable and fuel nozzles in combination of some of the shapes may be installed.

Figure 7:
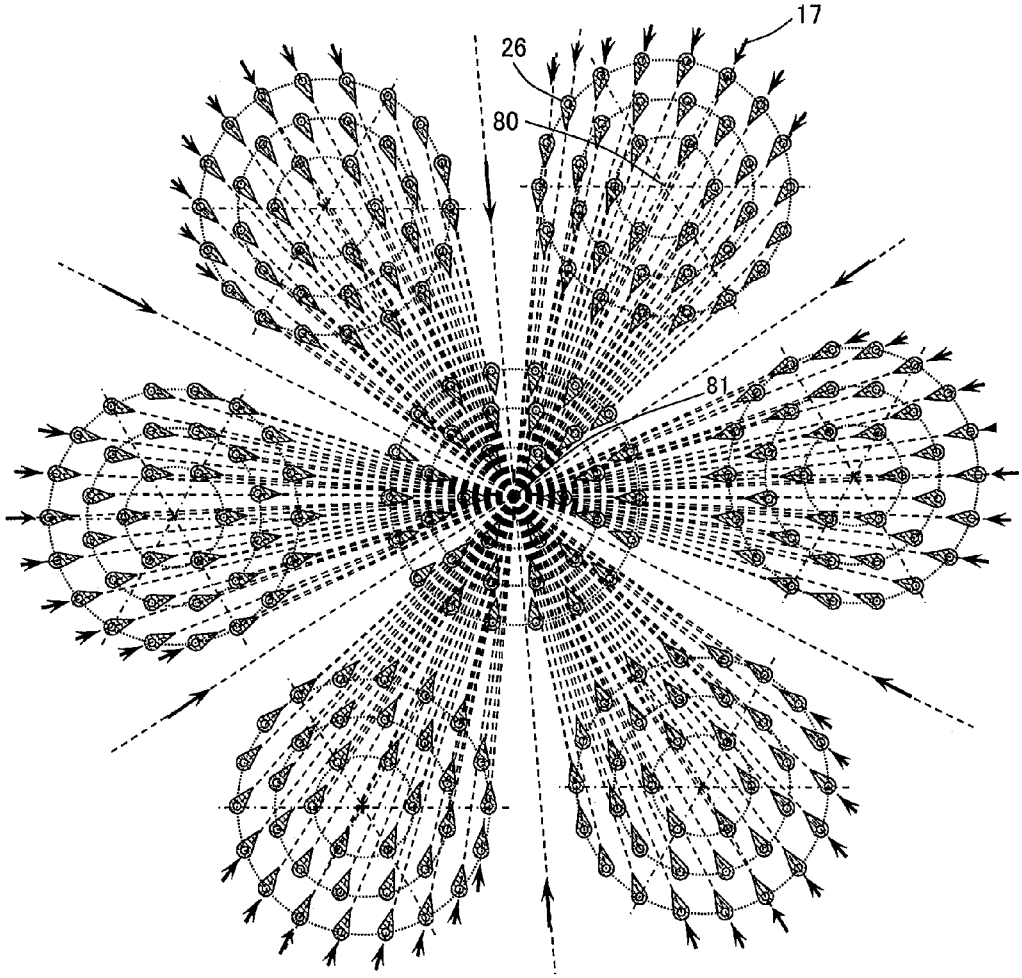
FIG. 7 is an arrangement diagram of the fuel nozzle showing the arrangement method of the fuel nozzle by the axial perpendicular section of the gas turbine combustor in the second embodiment of the present invention.

In FIG. 7, by the axial perpendicular sectional drawing of the multi-burner 34 on the section 38 of the gas turbine combustor 2 shown in FIG. 6A, the outline of the arrangement of the fuel nozzles 26 of the present embodiment is shown.

In the case of the structure of the multi-burner 34 in the gas turbine combustor 2 of the present embodiment, the center 80 of the central burner 35 of the gas turbine combustor 2 coincides with the center 81 of the gas turbine combustor 2, so that the edge 62 which is the projection at the rear edge of the fuel nozzle 26 is arranged so as to be directed to the center 81 of the burner in the flow direction of the combustion air flow 17.

Namely, it is the same arrangement method as that of the fuel nozzles 26 in the gas turbine combustor 2 of the first embodiment shown in FIG. 4. However, as for the outer peripheral burner 36 among the plurality of burners configuring the gas turbine combustor 2 of the present embodiment, the center 80 thereof and the center 81 of the gas turbine combustor 2 do not coincide with each other and the combustion air 17, as shown in FIG. 7, flows toward the center 81 of the gas turbine combustor 2 instead of the center 80 of the burner 36.

Therefore, the fuel nozzles 26 of the burner 6 positioned on the outer periphery of the gas turbine combustor 2, as shown in FIG. 7, are arranged so that all edges 62 on the downstream side of the combustion air flow 17 are directed to the center 81 of the gas turbine combustor 2 instead of the burner center 80.

According to the gas turbine combustor 2 of the present embodiment, similarly to the single burner 6, even in the multi-burner 34, the separating of the flow behind the fuel nozzles 26 is suppressed and the pressure loss can be reduced. In addition, the flow around the fuel nozzles 26 is adjusted, thus the unsteady hydrodynamic force acting on the fuel nozzles 26 caused by the separating of the flow is suppressed and the reliability of the structure of the gas turbine combustor 2 is improved.

Further, on the downstream side of the pairs of the fuel nozzle 26 and the air hole 32 to be focused, that is, turbulence of the combustion air 17 flowing into the pairs of the fuel nozzle 26 and the air hole 32 closer to the combustor center 81 is reduced, so that the flow-in rate of the combustion air 17 into the air hole 32 is unified, and the local fuel air ratio in the combustion chamber 5 of the gas turbine combustor 2 becomes uniform, thus the NOx emission is reduced.

Therefore, according to the present embodiment, even in a gas turbine combustor in which a multi-burner is configured by combining a plurality of burners, the reduction of the pressure loss can be realized without increasing the NOx emission.

As explained above, according to the present embodiment, a gas turbine combustor capable of reducing the pressure loss without increasing the NOx emission can be realized.

Embodiment 3

Next, the gas turbine combustor 2 which is the third embodiment of the present invention will be explained by referring to FIG. 8.

In the gas turbine combustor 2 of the third embodiment shown in FIG. 8, the explanation of the structure and operation effects common to the gas turbine combustor 2 of the first embodiment is omitted and only the different portions will be explained below.

Figure 8:
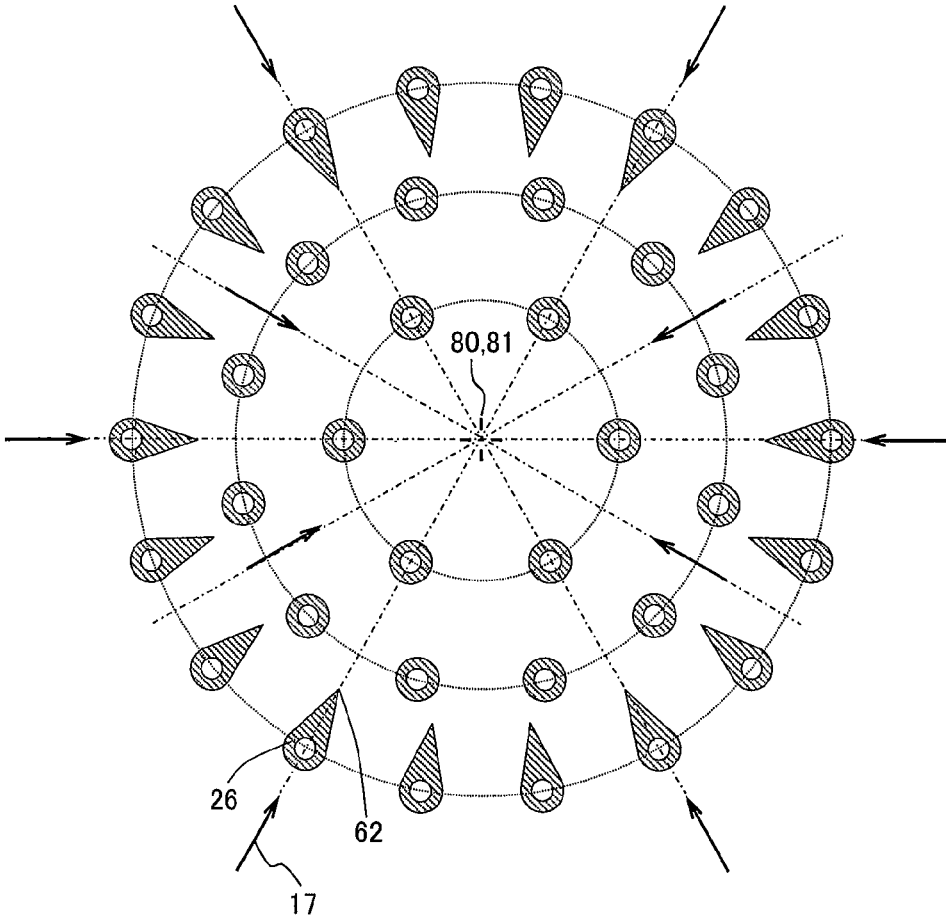
FIG. 8 is an arrangement diagram of the fuel nozzle showing the arrangement method of the fuel nozzle in the third embodiment of the present invention.

FIG. 8 shows the arrangement method of the fuel nozzles 26 in the gas turbine combustor 2 of the third embodiment. Like the burner 6 shown in the gas turbine combustor 2 of the first embodiment, when the fuel nozzles 26 are arranged coaxially in a plurality of circular rows outward radially from the center of the gas turbine combustor, as for the flow rate of the combustion air 17 flowing around the fuel nozzles 26, the combustion air 17 flowing around the fuel nozzles 26 arranged on the outer periphery side is higher in the flow rate than that of the fuel nozzles 26 arranged on the inner periphery side.

Namely, as for the fuel nozzles 26 arranged in the plurality of circular rows, a fuel nozzle 26 positioned on a more outer periphery side has a larger recirculation flow formed behind it and the pressure loss associated with it is increased.

Therefore, the pressure loss reduction effect due to changing of the shape thereof to the shape of the edge 62 which is the shape of the projection at the rear edge of the fuel nozzle 26 shown in the gas turbine combustor 2 of the first embodiment becomes larger in the fuel nozzle 26 positioned on the outer periphery side than in the fuel nozzle 26 positioned on the inner periphery side.

Meanwhile, in association with the shape change of the projection at the rear edge of each fuel nozzle 26, there are possibilities that the machining costs of the fuel nozzles 26 and the gas turbine combustor itself may increase. To suppress the increase in the machining costs, a method of reducing the number of fuel nozzles 26 whose shape is to be changed may be considered.

In that case, as shown in FIG. 8, among the fuel nozzles 26 arranged in a plurality of circular rows, only the fuel nozzle 26 on the outermost periphery is changed to the exact shape of the edge 62 which is the projection at the rear edge of the fuel nozzle 26 of the gas turbine combustor 2 of the first embodiment, and thereby the pressure loss reduction effect can be maximized by suppressing the increase in the machining costs.

Even when the fuel nozzles of the gas turbine combustor 2 are arrayed in four or more circular rows, only the fuel nozzle 26 on the outermost periphery thereof is changed to the exact shape of the edge 62 which is the shape of the projection shown in the fuel nozzle 26 of the gas turbine combustor 2 of the first embodiment, and thereby the effect similar to the case of the fuel nozzles 26, arranged in three rows, of the gas turbine combustor 2 can be obtained.

Further, if the increase in the machining costs is permitted to a certain extent, the shape change of the fuel nozzles 26 is not restricted to the outermost periphery and within the range with the increase permitted, on a priority basis from the outermost periphery, the shape of the fuel nozzles 26 on a plurality of peripheries can be changed.

As mentioned above, according to the gas turbine combustor 2 of the present embodiment, the number of fuel nozzles 26 whose shape is changed is restricted, and thereby the pressure loss reduction can be realized while suppressing the increase in the machining costs.

As explained above, according to the present embodiment, a gas turbine combustor capable of reducing the pressure loss without increasing the NOx emission can be realized.

Embodiment 4

Next, the gas turbine combustor 2 which is the fourth embodiment of the present invention will be explained by referring to FIG. 9.

In the gas turbine combustor 2 of the fourth embodiment shown in FIG. 9, the explanation of the structure and operation effects common to the gas turbine combustor 2 of the first embodiment is omitted and only the different portions will be explained below.

Figure 9:
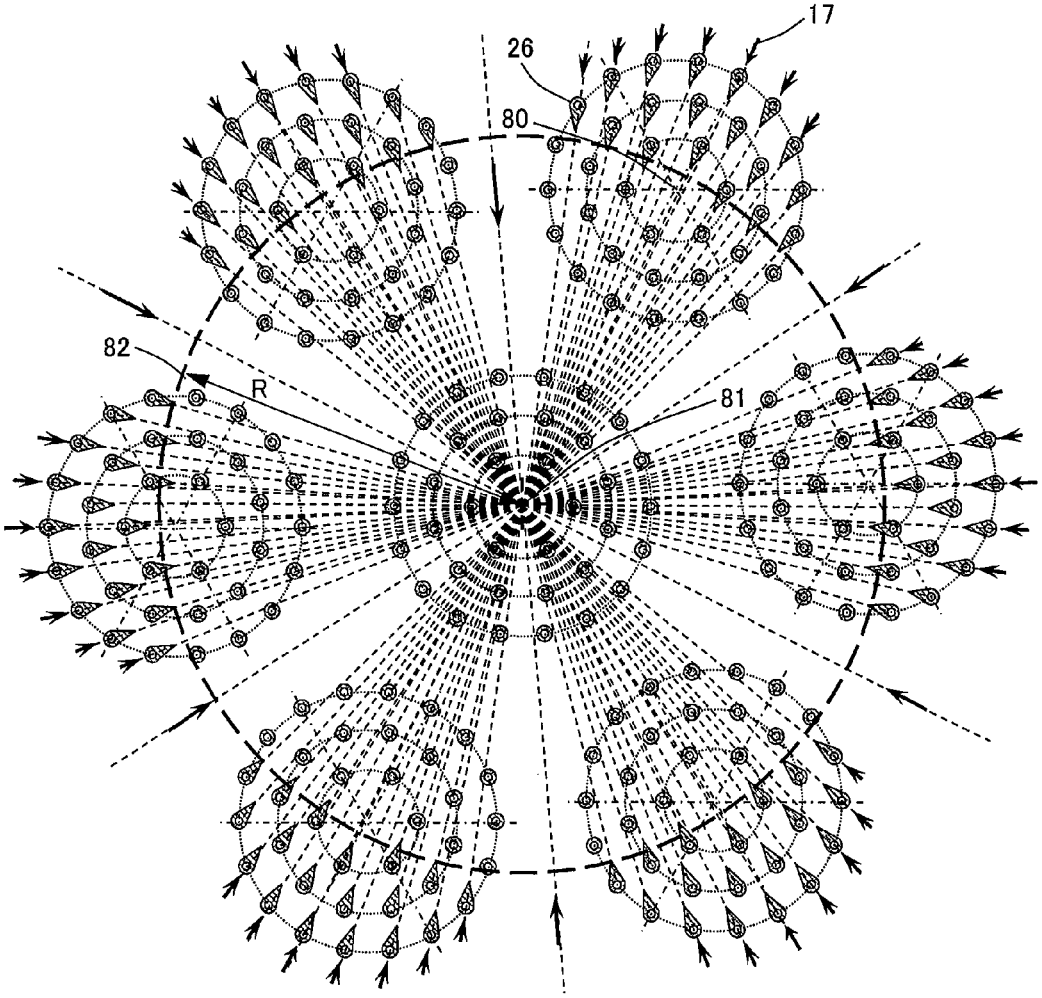
FIG. 9 is an arrangement diagram of the fuel nozzle showing the arrangement method of the fuel nozzle in the fourth embodiment of the present invention.

FIG. 9 shows the arrangement method of the fuel nozzles 26 in the gas turbine combustor 2 of the fourth embodiment. The third embodiment showed the arrangement method of the fuel nozzles 26 in the gas turbine combustor 2 configured by one burner 6, and this method is for reducing the pressure loss while suppressing the increase in the machining costs in association with the shape change of the fuel nozzles 26. By contrast, in the arrangement method of the fuel nozzles 26 in the gas turbine combustor 2 of the present embodiment, even in the gas turbine combustor for forming one multi-burner 34 in combination with a plurality of burners which is shown in the gas turbine combustor 2 of the second embodiment, the arrangement method of the fuel nozzles 26 capable of obtaining the similar effects to the gas turbine combustor 2 of the third embodiment is shown.

Even in the gas turbine combustor 2 of the present embodiment for forming one multi-burner 34 in combination with a plurality of burners, the flow rate of the combustion air flowing around the fuel nozzles 26 becomes higher as the combustion air is separated from the combustor center 81, so that as the fuel nozzles 26 are separated from the combustor center 81, the recirculation flow formed behind it becomes larger and the pressure loss in association with it also becomes larger. Therefore, the shape thereof is changed to the shape of the fuel nozzles 26 shown in the gas turbine combustor 2 of the first embodiment, and thereby the pressure loss reduction effect becomes higher.

Therefore, a circle 82 having a radius of R with the combustor center 81 as the center is defined and only the fuel nozzles 26 whose centers are positioned outside the circle 82 are changed to the shape of the fuel nozzles 26 shown in the gas turbine combustor 2 of the first embodiment, and thereby the number of nozzles whose shape will be changed is restricted, and by suppressing the increase in the machining costs of the fuel nozzles 26, the pressure loss reduction effect can be maximized.

The radius R of the circle 82 is determined by the changeable number of fuel nozzles which is calculated from the allowable increase in the machining costs or the required magnitude of pressure loss reduction.

As mentioned above, according to the gas turbine combustor 2 of the present embodiment, even in the gas turbine combustor for forming one multi-burner in combination with a plurality of burners, the number of nozzles for changing the shape thereof is restricted, thus the pressure loss reduction can be realized while suppressing the increase in the machining costs.

As explained above, according to the present embodiment, a gas turbine combustor capable of reducing the pressure loss without increasing the NOx emission can be realized.

Embodiment 5

Next, the gas turbine combustor 2 which is the fifth embodiment of the present invention will be explained by referring to FIGS. 10A to 10F.

In the gas turbine combustor 2 of the fifth embodiment shown in FIGS. 10A to 10F, the explanation of the structure and operation effects common to the gas turbine combustor 2 of the first embodiment is omitted and only the different portions will be explained below.

In the gas turbine combustor 2 of the present embodiment, the structure of the fuel nozzle 26 of the gas turbine combustor 2 capable of suppressing the separating of the flow of the combustion air behind the fuel nozzle 26, reducing the pressure loss of the gas turbine combustor, and inserting the tip of the fuel nozzle 26 into the air hole 32 formed in the air plate 31 is shown.

FIGS. 10A to 10F are drawings showing the shape of the fuel nozzle 26 of the gas turbine combustor 2 of the present embodiment.

As shown in FIGS. 10A to 10F, in the fuel nozzle 26 of the gas turbine combustor 2 of the present embodiment, a structure of intending mixing enhancement of fuel and air in the air hole 32 formed in the air plate 31 and inserting the tip of the fuel nozzle 26 into the air hole 32 may be considered.

However, in the shape of the fuel nozzle 26 of the gas turbine combustor 2 shown in the first embodiment, the maximum width of the section of the fuel nozzle 26 becomes larger than the diameter of the air hole 32 and the fuel nozzle 26 may not be inserted into the air hole 32.

Figure 10A:
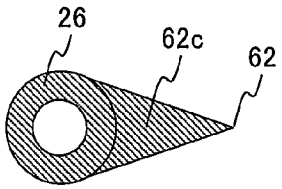
FIG. 10A is a cross sectional view of the fuel nozzle showing the shape of the fuel nozzle of one aspect of an embodiment in the fifth embodiment of the present invention.
Figure 10B:
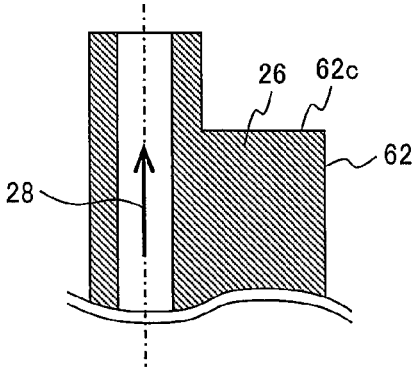
FIG. 10B is an axial cross sectional view of the fuel nozzle in the fifth embodiment of the present invention shown in FIG. 10A.
Figure 10C:
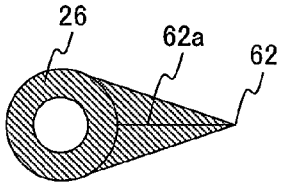
FIG. 10C is a cross sectional view of the fuel nozzle showing the shape of the fuel nozzle of another aspect of an embodiment in the fifth embodiment of the present invention.
Figure 10D:
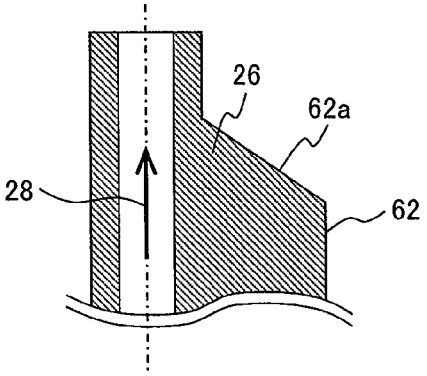
FIG. 10D is an axial cross sectional view of the fuel nozzle in the fifth embodiment of the present invention shown in FIG. 10C.
Figure 10E:
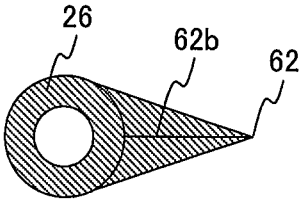
FIG. 10E is a cross sectional view of the fuel nozzle showing the shape of the fuel nozzle of still another aspect of an embodiment in the fifth embodiment of the present invention and the flow of the combustion air around it.
Figure 10F:
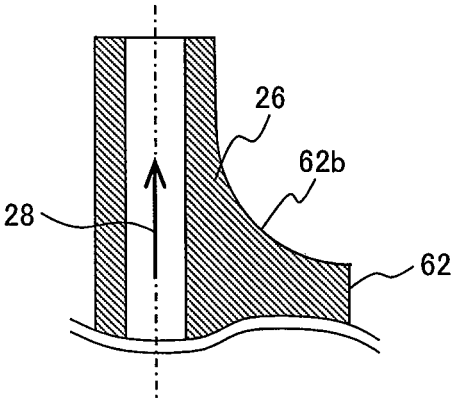
FIG. 10F is an axial cross sectional view of the fuel nozzle in the fifth embodiment of the present invention shown in FIG. 10E.

Therefore, in the fuel nozzle 26 of the gas turbine combustor 2 of the present embodiment, as shown in FIGS. 10A and 10B, the shape of the fuel nozzle 26, from the shape of the edge 62 which is the projection in which the section of the base of the fuel nozzle 26 in the axial direction is projected on the rear edge side, is formed so as to be a cylindrical shape with the section of the tip of the fuel nozzle 26 formed circularly, thereby allowing the tip of the fuel nozzle 26 to be inserted into the air hole 32 while reducing the pressure loss due to separating of the flow of combustion air is reduced.

Further, in the shape of the fuel nozzle 26 of the gas turbine combustor 2 of the present embodiment shown in FIGS. 10A and 10B, since the shape of the base and the shape of the tip are changed at the discontinuous portion 62*c* between the base and the tip discontinuously, there are possibilities that turbulence generated due to separating of the flow in the discontinuous portion may affect the flow-in of the combustion air 17 into the air hole 32.

Therefore, as shown in FIGS. 10C, 10D, 10E, and 10F, the shape of the fuel nozzle 26 of the gas turbine combustor 2 of the present embodiment forms the continuous portions 62*a*, 62*b* between the base and the tip for continuously changing smoothly to the cylindrical tip of the fuel nozzle 26 from the shape of the edge 62 which is the projection formed at the base of the fuel nozzle 26, thus the turbulence of the flow generated in the discontinuous portion can be suppressed.

By the aforementioned fuel nozzle 26 of the gas turbine combustor 2 of the present embodiment, the separating of the flow of the combustion air 17 behind the fuel nozzle 26 is suppressed, and the pressure loss of the gas turbine combustor is reduced, and the insertion of the tip of the fuel nozzle 26 into the air hole 32 can be realized.

As explained above, according to the present embodiment, a gas turbine combustor capable of reducing the pressure loss without increasing the NOx emission can be realized.

The invention claimed is:

1. A gas turbine combustor comprising: a burner including a plurality of fuel nozzles for injecting a fuel; a fuel nozzle header for distributing the fuel to the plurality of fuel nozzles; an air hole plate positioned on a downstream side of the plurality of fuel nozzles and the air hole plate includes a plurality of air holes arranged to correspond with each of the fuel nozzles; and a combustion chamber in which a mixture of the fuel injected from the plurality of fuel nozzles and a combustion air are injected from the plurality of air holes and burned in the combustion chamber, wherein: two or more of the plurality of fuel nozzles each respectively have a projection which protrudes perpendicularly from an axis of the fuel nozzle which is parallel to the general flow of the combustion gas, wherein the projection tapers radially inward of the fuel nozzle with respect to the general flow of the combustion gas, the projection is positioned on a downstream side of a flow of the combustion air flowing around each of the two or more of the plurality of fuel nozzles, and the projection is located in a space between the air hole plate and the fuel nozzle header.

2. The gas turbine combustor according to claim 1, wherein:

the projection is formed in a shape with an edge.

3. The gas turbine combustor according to claim 1, wherein: the projection is formed in a shape where a width of the projection is reduced radially inward of the fuel nozzle with respect to the general flow of the combustion gas, and the outer edge of the fuel nozzle has a curvature.

4. The gas turbine combustor according to claim 1, wherein:

the burner is a multi-burner including a central burner and a plurality of outer peripheral burners installed on an outer peripheral side of the central burner.

5. The gas turbine combustor according to claim 1, wherein: the plurality of air holes formed in the air hole plate positioned on a tip side of the plurality of fuel nozzles are arranged in pairs with the plurality of fuel nozzles, the plurality of fuel nozzles and the plurality of air holes are arranged coaxially in a plurality of concentric circles, and each of the plurality of fuel nozzles in an outer one of the concentric circles respectively has the projection.

6. The gas turbine combustor according to claim 1, wherein: each of the plurality of fuel nozzles has the projection which is protruded outward at a base of the fuel nozzle, and has a cylindrical shape at a tip of the fuel nozzle.

7. The gas turbine combustor according to claim 6, wherein: each of the plurality of fuel nozzles has the projection having a shape which is changed continuously between the base and the tip of the fuel nozzle.

8. A gas turbine combustor, comprising: a burner including a plurality of fuel nozzles for injecting a fuel; a fuel nozzle header for distributing the fuel to the plurality of fuel nozzles; an air hole plate positioned on a downstream side of the plurality of fuel nozzles and the air hole plate includes a plurality of air holes arranged to correspond with each of the plurality of fuel nozzles; and a combustion chamber in which a mixture of the fuel injected from the plurality of fuel nozzles and a combustion air are injected from the plurality of air holes and burned in the combustion chamber, wherein: a first one or more of the fuel nozzles each respectively have a first projection which protrudes perpendicularly from an axis of the fuel nozzle which is parallel to the general flow of the combustion gas, wherein the first projection tapers radially inward of the fuel nozzle with respect to the general flow of the combustion gas, the first projection is positioned on a downstream side of a flow of the combustion air flowing around each of the first one or more fuel nozzles, and the first projection is located in a space between the air hole plate and the fuel nozzle header, and a second one or more of the fuel nozzles each respectively have a second projection which protrudes perpendicularly from an axis of the fuel nozzle which is parallel to the general flow of the combustion gas, wherein a width of the second projection tapers to form a curved shape radially inward of the fuel nozzle with respect to the general flow of the combustion gas, the second projection is positioned on a downstream side of a flow of the combustion air flowing around each of the second one or more of the fuel nozzles, and the second projection is located in a space between the air hole plate and the fuel nozzle header.

* * * * *